US005427259A

United States Patent [19]

Krastanov

[11] Patent Number: 5,427,259

[45] Date of Patent: Jun. 27, 1995

[54] APPARATUS AND METHOD FOR NURSING AN INFANT

[76] Inventor: Emil R. Krastanov, 153 Leach Ave., Brocton, Mass. 02401

[21] Appl. No.: 258,054

[22] Filed: Jun. 10, 1994

[51] Int. Cl.[6] ..... A61J 9/06

[52] U.S. Cl. ..... 215/11.1; 248/104; 215/399; 224/148

[58] Field of Search ..... 215/11.1, 100 R; 224/148, 258; 248/102, 104

[56] References Cited

U.S. PATENT DOCUMENTS

| | | | |
|---|---|---|---|
| 853,362 | 5/1907 | Hobson | 248/104 |
| 2,938,693 | 5/1960 | Vardan | 248/104 |
| 3,065,944 | 11/1962 | Liebendorfer | 248/102 |
| 3,144,230 | 8/1964 | Brooks | 248/102 |
| 3,977,638 | 8/1976 | Woodard . | |
| 4,034,945 | 7/1977 | Sato . | |
| 4,498,613 | 2/1985 | Donahue et al. | 224/258 X |
| 4,564,957 | 1/1986 | Scharf | 248/102 X |
| 4,570,808 | 2/1986 | Campbell et al. | 215/11.1 |
| 4,700,856 | 10/1987 | Campbell et al. | 215/11.1 X |
| 5,147,079 | 9/1992 | Heather . | |
| 5,165,558 | 11/1992 | Cargile | 215/100 R |
| 5,167,354 | 12/1992 | Cohanfard | 224/148 |
| 5,207,719 | 5/1993 | Janus . | |

FOREIGN PATENT DOCUMENTS

| | | | |
|---|---|---|---|
| 8406703 | 7/1984 | Denmark | 224/258 |

*Primary Examiner*—Allan N. Shoap
*Assistant Examiner*—Christopher McDonald
*Attorney, Agent, or Firm*—Steven G. Saunders

[57] ABSTRACT

An apparatus and method for nursing an infant, comprising in combination a cord adapted to extend around the neck of a person, a disk defining a hole to secure the cord, and an infant feeding bottle having a fluid container defining a bottle hole to secure the disk within the bottle hole.

11 Claims, 3 Drawing Sheets

APPARATUS AND METHOD FOR NURSING AN INFANT

FIELD OF THE INVENTION invention relates generally to an apparatus and method for nursing an infant, and more particularly concerns an apparatus and method for nursing an infant where a person nursing the infant need use at most only one hand/arm in nursing the infant.

BACKGROUND OF INVENTION

A person who is nursing a young infant on that person's lap, a/k/a "lap nursing", must use both arms to effectively perform the task. One arm/hand must support the infant's head and/or body while the other arm/hand supports the bottle. This nursing configuration completely incapacitates the person who is nursing the infant for the full time that the infant is nursing. While nursing, the person cannot read a book, drink a beverage, answer the telephone, comfort the infant, or even wipe drool from the infant's mouth. In order to do anything else while nursing the infant, the person must remove the bottle from the infant's mouth and find a surface to place the bottle upon. This disrupts the feeding process and further is likely to give the infant more of a gas problem than if the nursing process is not disrupted. Since a young infant generally needs to be nursed for up to thirty minutes every three to four hours per day, a person who regularly lap nurses such an infant stands to lose as much as four hours per day.

similarly, a person who has the use of only one arm and/or a prosthesis that is incapable holding a bottle cannot effectively lap nurse an infant in the manner described above. Such a person cannot thus care for a small infant who must be nursed in a person's arms.

There have been attempts in the prior art to overcome the noted limitations placed upon a person lap nursing an infant. U.S. Pat. No. 3,977,638, to Woodard, dated Aug. 31, 1976 discloses a halter type nursing bottle support that is adapted to fit around the neck of a person lap nursing an infant. A flexible fixed sized elastic strap is wrapped around a bottle which supports the bottle while nursing an infant. Such a device, however, is constrained to fit only one size of bottle. A narrow bottle would likely slip out of the strap or be likely to be pulled out of the strap by the infant. Similarly, a bottle with a larger circumference or an odd shape would be difficult to place within the strap and also be difficult to maneuver after the infant has finished nursing. As previously noted, such a device is specifically adapted to be used with only one sized bottle as it would be incompatible with any oddly sized or shaped baby bottle. Furthermore, Woodard is not easy to manipulate and use. The bottle is set to one position when in use; specifically pointed downward toward the infant. When lap nursing, the bottle is not easily adjustable to another, namely upright position. The bottle must be disconnected and then reconnected in order to point the bottle upward.

Woodard discloses several other patents that attempt to solve the above noted problems encountered in nursing an infant. Each of the listed references, however, is based upon an elastic type of bottle support similar to Woodward. These references thus suffer from deficiencies similar to Woodard in accomplishing their ultimate goals.

U.S. Pat. No. 4,034,945, to Sato, dated Jul. 12, 1977, discloses a device for suspending a nursing bottle. Such a device is disclosed to be utilized only in a crib, playpen, or the like and thus does not solve the problems encountered by a person who lap nurses an infant.

Accordingly, there is a great need for a device that can be utilized by a person to effectively and easily lap nurse an infant, where such a device requires the use of at most one arm and thus does not constrain both arms, thereby leaving one arm free to perform other tasks. There is also a great need for a device to effectively and easily lap nurse an infant that can be utilized by a person who has the use of at most one arm.

SUMMARY OF INVENTION

It is therefore an object of this invention to provide a device and method to efficiently and easily lap nurse an infant.

It is another object of this invention to provide a device that allows a person to maintain at least one free arm while lap nursing an infant.

It is also an object of this invention to provide a device and method that allows a handicap person who has the use of no more than one arm to lap nurse an infant.

It is a further object of this invention to provide an inexpensive and simple device for lap nursing an infant that allows a person to maintain at least one free arm while lap nursing the infant.

It is yet another object of this invention to provide a device and method that allows a person who is lap nursing an infant to more efficiently utilize the time spent nursing the infant.

It is still a further object of this invention to provide a device and method that allows a person lap nursing an infant to soothe the infant, wipe drool and other fluids from the infant's face and body while nursing, and more effectively aid the infant in consuming the contents of a nursing bottle.

This invention results from the realization that a person lap nursing an infant can free up one arm to perform other useful tasks where a nursing bottle is effectively and uniquely suspended from the person's neck. Such a suspension and bottle support device can be designed from a few simple customized parts thus minimizing the costs associated with manufacturing and producing the device.

The above and other objects are achieved in accordance with the present invention which, according to a first aspect provides an apparatus for nursing an infant comprising a cord fastened to a round disk that is coupled to an infant feeding bottle. The ends of the cord are fastened through a hole at the center of the disk. The disk is coupled to the infant feeding bottle via a bottle hole in a container of the bottle by being secured between two containing branches that define the bottle hole. The round disk, which may be made of a plastic composite, has a first side that is flat and a second side that is rounded. The cord may be made of a flexible rubber composite or twisted strands of fibers.

According to a second aspect of the invention, an infant nursing apparatus is disclosed similar to the first aspect of the invention. A member having a means for fastening the two ends of the cord to form a loop is used in place of the disk. The infant feeding bottle similarly has a nipple and a fluid container. The member has a curved side that defines a concavity.

According to a third aspect of the invention, a method of nursing an infant is disclosed where a person is holding an infant upon his/her lap and supporting the infant with one arm. A member is suspended from the neck of that person while the member couples with an infant feeding bottle having a nipple. The bottle is then rotated to an angle such that the infant is able to suck from the nipple, thus allowing the infant to drink from the bottle.

DISCLOSURE OF PREFERRED EMBODIMENT

Other objects, features, and advantages of this invention will occur to those skilled in the art from the following description of a preferred embodiment and the accompanying drawings, in which:

Turning first to FIG. 1, there is shown a top view of the suspension and fastening parts embodying a preferred embodiment of the present invention.

Figure 1:
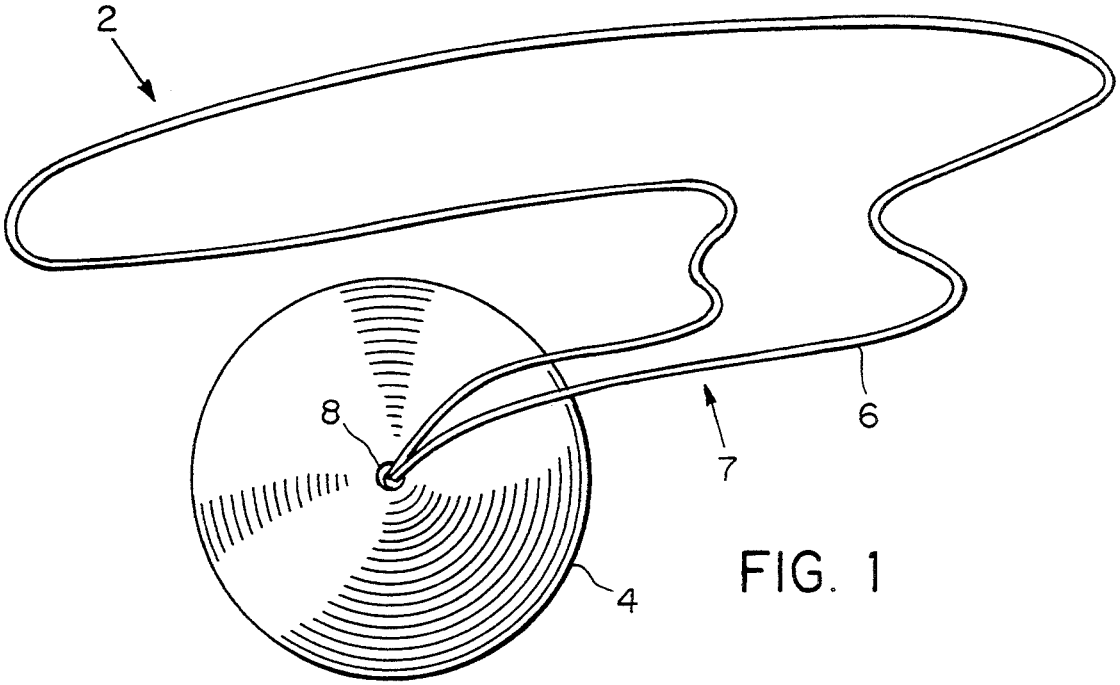

There is shown in FIGS. 1–4 a preferred embodiment of the invention as claimed. FIG. 1 shows a suspender 2 from a top view comprising round disk 4 and cord 6. Cord 6 is fastened to a disk 4 through a hole 8, where both ends of cord 6 are tied together into a knot 10. Cord 6 is preferably long enough such that when fastened to disk 4, it creates a loop 7 that is large enough to fit over a person's head. The circumference of loop 7 may be adjusted, however, by allowing more slack in either or both of the ends of cord 6 when tying knot 10 through hole 8. Such a feature allows more flexibility in adjusting the placement of suspender 2 when using the invention. Hole 8 is preferably in the center of disk 4 to ensure proper balance of suspender 2 when in use.

Figure 2:
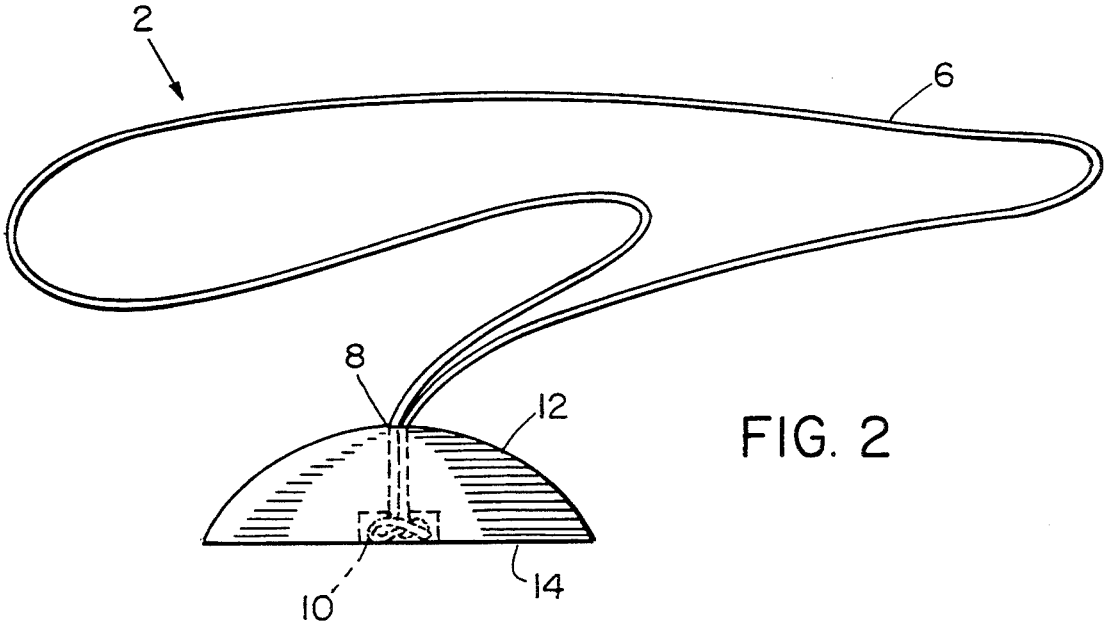
FIG. 2 shows a side plan view of a preferred embodiment of the suspension and fastening parts shown in FIG. 1.

As disclosed in the side plan view of suspender 2 in FIG. 2, knot 10 may be any knot that is capable of securing both ends of cord 6 to disk 4. The preferred embodiment of suspender 2 as shown in FIG. 2 has a top side 12 which is rounded or curved, and a bottom side 14 that is flat. Disk 4 is preferably manufactured of a plastic composite to ensure rigidity thereby preventing accidental uncoupling of a bottle 26 that is suspended from suspender 2. Similarly, cord 6 is preferably manufactured of any rope or other type of twisted fiber strands that are strong enough to support bottle 26 and any other forces that may potentially strain cord 6.

Figure 3:
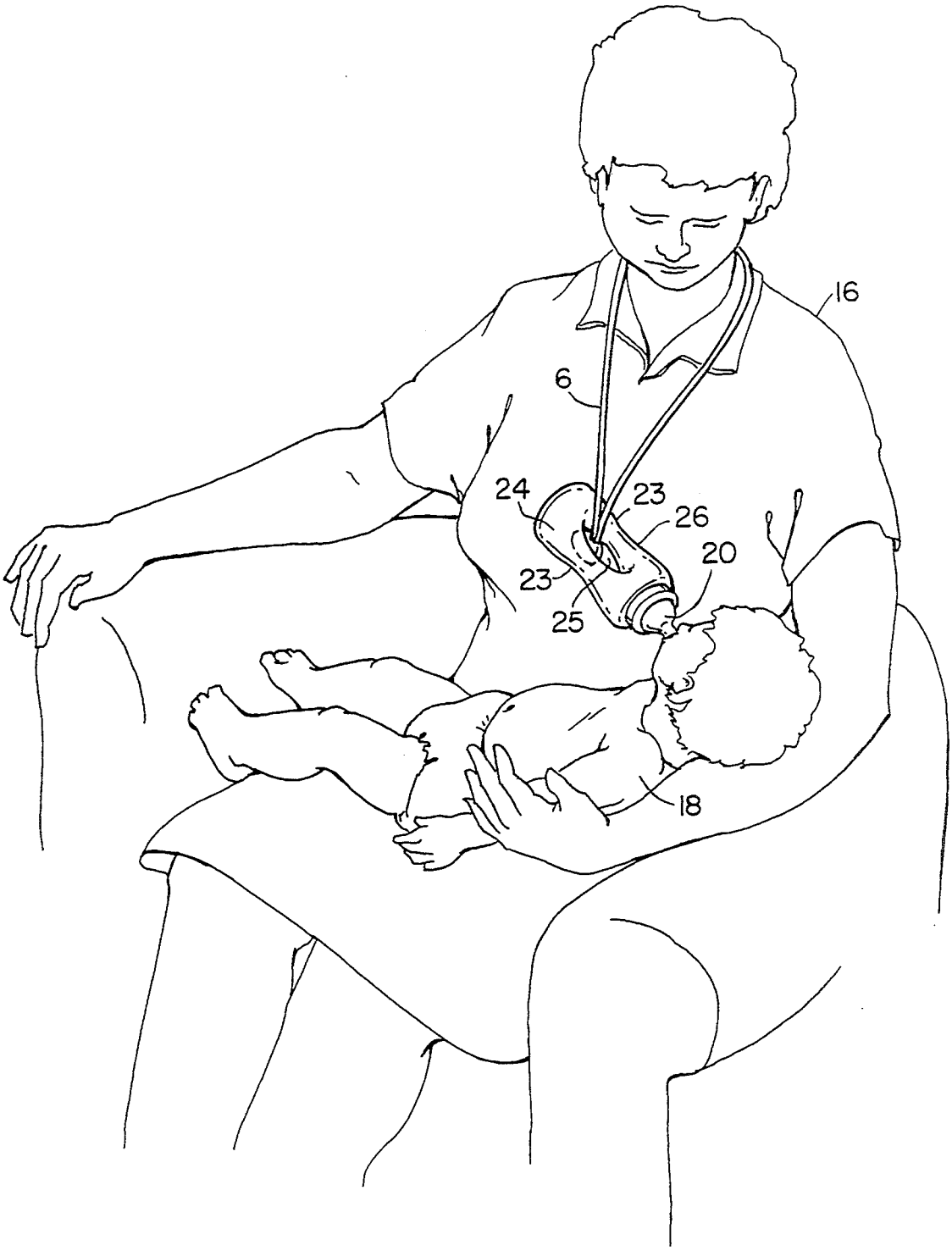
FIG. 3 shows a preferred use of the present invention while lap nursing an infant.
Figure 4:
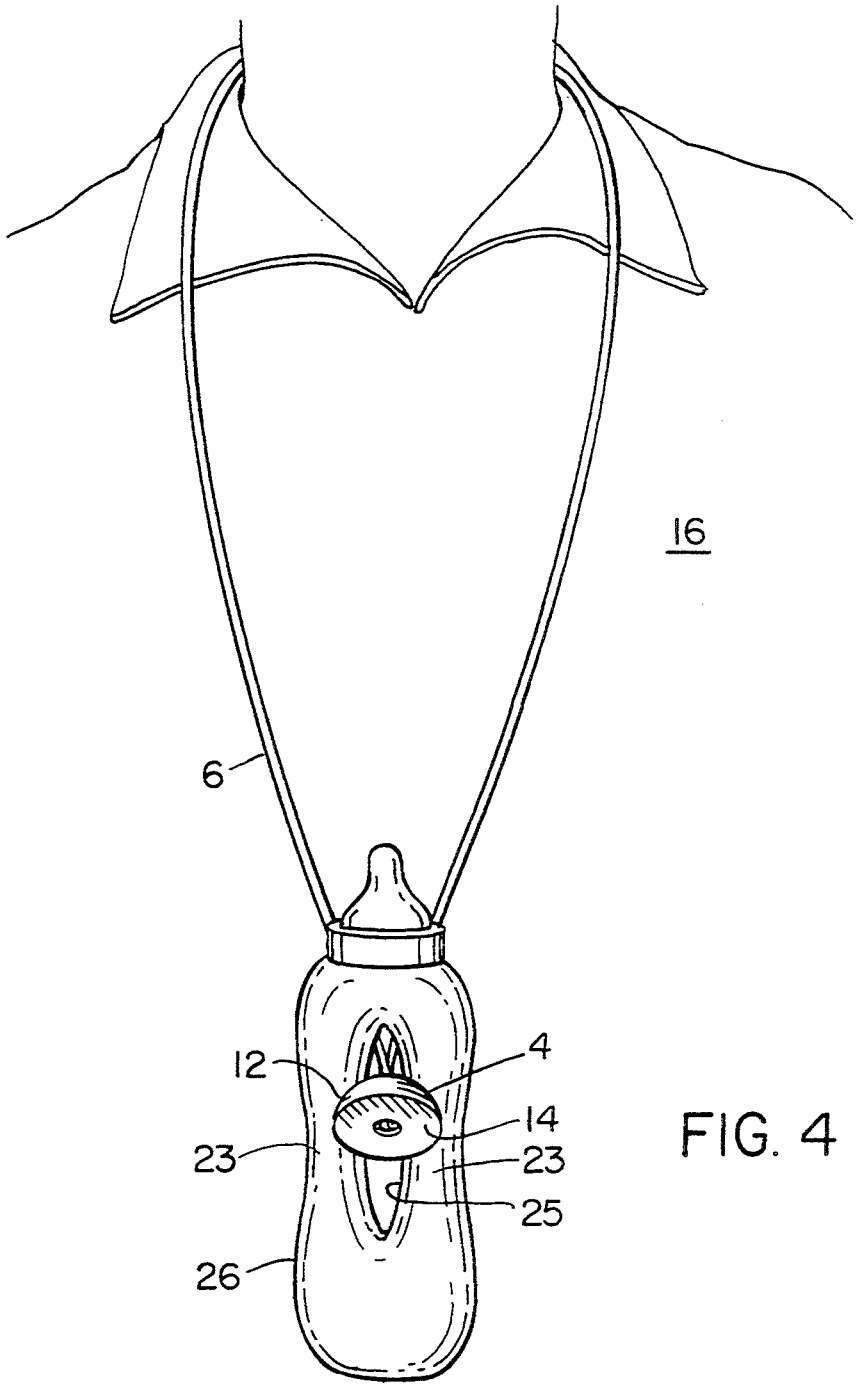
FIG. 4 shows an alternative use of the present invention just prior to or after to lap nursing.

FIGS. 3 and 4 demonstrate a preferred use of the invention. Loop 7 is placed around the neck of a person 16 who is nursing or otherwise feeding an infant 18 on the lap of person 16. FIG. 3 shows infant 18 being supported by the left arm of person 16. This method of nursing or feeding an infant has been defined as "lap nursing" or "lap feeding" an infant or baby.

Bottle 26 is coupled to suspender 2 and is adapted to be tilted at an acute angle on the horizontal to enable easy access to a nipple 20 of bottle 26 by infant 18. Bottle 26 preferably has nipple 20 and a fluid container 24 to contain juice, milk, water, or other fluid that is being fed to infant 18. Container 26 has branches 23 that define a preferably oval or other non circular bottle hole 25. To begin lap nursing infant 18, disk 4 is inserted through bottle hole 25 and subsequently slid towards the bottom end of bottle 26 thus fastening disk 4 within bottle hole 25. Rounded top side 12 of disk 4 is in contact with bottle 26, while bottom side 14 of disk is facing away from person 16. Rounded side 12 can be designed to have a corresponding surface shape to bottle 26, thus allowing a firmer and more secure coupling with bottle 26.

FIG. 4 shows a corresponding use of the invention either before or after lap nursing. Prior to lap nursing, person 16 places bottle 26 at an upright position to prevent potential leakage of the fluid within bottle 26. At this time, person 16 is able to position infant 18 on the lap of person 16 to begin lap nursing. While supporting infant 18 with one arm, person 16 is now able to rotate bottle 26 to a favorable acute angle to begin lap nursing. When the lap nursing process is completed, person 16 then is able to rotate bottle 26 back into an upright position again, and return infant 18 to his/her crib, playpen, or other location. It is preferable for loop 7 to be of such a circumference such that cord 6 fits loosely around the neck of person 16 while person 16 is lap nursing infant 18.

EXAMPLE

In a preferred embodiment, round disk 4 has a diameter of 1.75 inches and an approximate thickness of 0.44 inches. Top side 12 is rounded and bottom side 14 is flat. The ends of cord 6, which is 27.0 inches in length, are tied into a knot 10 within hole 8, thus yielding a loop 7 that has a circumference of 26.0 inches. Cord 6 is a conventional rope and disk 4 is comprised of a plastic composite. Person 16 places loop 7 over his/her head to rest loosely upon his/her chest. Disk 4 is placed within oval shaped bottle hole 25 as top side 12 is in physical contact with bottle 26. Infant 18 is supported by the left arm of person 16 as person 16 rotates bottle 26 to an acute angle on the horizontal for effective lap nursing. The right arm of person 16 is free to read, answer the telephone, wipe drool, or perform any other function upon completion of lap feeding, the right arm of person 16 rotates bottle 26 upward as person 16 places infant 18 in a playpen.

Figure 5:
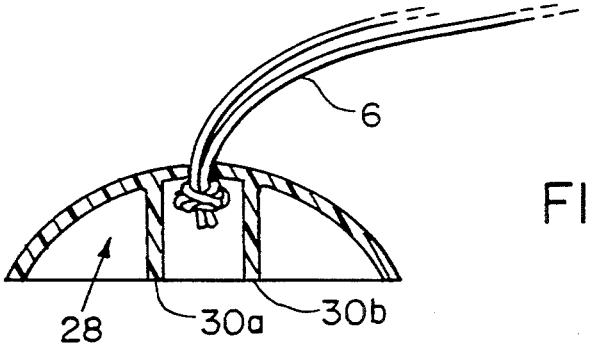
FIG. 5 shows an alternative embodiment of the present invention.

FIG. 5 shows an alternative embodiment in accordance with the invention. Specifically, disk 4 has a top side that is curved that defines a concavity 28. Protrusions **30*a* and 30*b* extend from the surface of the concavity to protect knot 10 from being tampered with by infant 18**.

This invention also enables people who have the use of only one arm to lap feed an infant. While supporting infant 16 with their only arm, person 18 may lap nurse infant 16 with the same ease as any person having the use of two arms. If some alternative infant support means or method is available, a person who does not have the use of either arm could use the invention to lap feed infant 18.

Although a preferred embodiment has been disclosed, the invention may be practiced through the use of many different configurations and variances from the preferred embodiment. Disk 4 may be a member of any shape that enables secure coupling to bottle 26. Similarly, cord 6 may be fastened to disk 4 through any conventional attachment means. An alternative embodiment of the invention allows person 16 to form a loop 7 that is smaller than the circumference of the head of person 16. This is accomplished by fastening the ends of cord 6 to disk 4 while cord 6 is around the neck of person 16. This eliminates the need to put loop 7 of the invention over the head of person 16. Furthermore, cord 6 may be any means that is capable of effectively suspending a member or disk 4 that is to support bottle 26. Cord 6 may thus be a chain, elastic band, string, shoelace, wire, fabric weave, flexible plastic composite, flexible rubber composite, or other useful means for suspending disk 4 or other member.

Disk 4 may be manufactured of any rigid or reasonably flexible material that is known in the art. It may consist of a plastic composite, wood, metal, clay, ceramic, or other material that is suitable for effectively coupling with bottle 26. As previously noted, it may also be of any shape to effectively couple with bottle 26. Bottle 26 must have some kind of means to couple with disk 4. Although an oval or other non circular bottle hole was previously disclosed for the preferred embodiment, the bottle hole may be any shape that effectively couples with any odd shaped disk 4. Even a circular shaped bottle hole 25 would suffice if the shape of disk 4 is capable of effectively coupling with bottle hole 25.

This invention is characterized by its simplicity and ease of use. Accordingly, the invention is inexpensive to manufacture and distribute and quite easy to operate. One fundamental advantage gained through the use of the invention is the fact that person 16 is able to lap feed infant 18 while keeping one arm free to perform other tasks, such as answering the telephone, soothing infant 18, read a book, and a multitude of additional tasks. Since feedings can cumulatively last for up to four hours, this lost time can be effective used to accomplish other tasks. Person 16 is not unnecessarily constrained. Furthermore, disk 4 is fastened well within bottle hole 25, thus preventing any accidental slippage of bottle 26 onto infant 18 or the potential that infant 18 could pull the bottle from suspender 2. The invention also is easily maneuverable. If infant 18 decides to terminate lap nursing, infant 18 can simply move his/her head, thereby causing bottle 26 to come out if his/her mouth. Finally, the invention gives people with one arm the ability to lap nurse infant 18.

Although specific features of this invention are shown in some drawings and not others, this is for convenience only as some feature may be combined with any or all of the other features in accordance with this invention.

The foregoing is considered as illustrative only of the principles of the invention. Furthermore, since numerous modifications and changes will readily occur to those skilled in the art, it is not desired that the foregoing limit the invention to the exact construction and operation shown and described. Accordingly, all suitable modifications and equivalents may be resorted to that appropriately fall within the scope of the invention.

Other embodiments therefore will occur to those skilled in the art and are within the scope of following claims:

What is claimed is:

1. An apparatus for nursing an infant, comprising in combination:

a. a cord having two ends adapted to extend around the neck of a person holding the infant;

b. a round disk having a center defining a disk hole to secure the two ends of said cord within said hole, said disk having a first side that is flat and a second side that is rounded; and c. an infant feeding bottle having a fluid container defining a bottle hole forming two containing branches, said disk removably coupled between said branches.

2. The nursing apparatus of claim 1, in which said disk is comprised of a plastic composite.

3. The nursing apparatus of claim 1, in which said cord is comprised of twisted strands of fibers.

4. The nursing apparatus of claim 1, in which said cord is comprised of a flexible plastic composite.

5. An infant nursing apparatus, comprising in combination:

a. a cord having two ends;

b. a member having a means for fastening the two ends of said cord such that said cord forms a loop; and c. an infant feeding bottle having a nipple and a fluid container defining a bottle hole forming two containing branches, said member removably coupled between the branches within the bottle hole, whereby said loop is adapted to fit loosely around the neck of a person feeding an infant as it is further adapted such that said feeding bottle is at an angle that is favorable to simple feeding of the infant.

6. The infant nursing apparatus of claim 5, in which said member is a disk having a top side that is curved.

7. The infant nursing apparatus of claim 6, in which said top side of disk defines a concavity.

8. The infant nursing apparatus of claim 7, in which said concavity includes a plurality of protrusions extending from the surface of said concavity.

9. The infant nursing apparatus of claim 8, in which said disk is comprised of a plastic composite.

10. The infant nursing apparatus of claim 9, in which said cord is comprised of twisted fibers.

11. The infant nursing apparatus of claim 10, in which the means for fastening includes a disk hole that is defined by a center of said disk, said cord ends fastened through the hole such that said top side of said disk is in contact with said bottle.

* * * * *